US005811703A

United States Patent [19]

Hoshino

[11] Patent Number: 5,811,703

[45] Date of Patent: Sep. 22, 1998

[54] PLURAL PIECE GUITAR BODY

[75] Inventor: Yoshihiro Hoshino, Nagoya, Japan

[73] Assignee: Hoshino GaKKI Kabushiki Kaisha, Nagoya, Japan

[21] Appl. No.: 806,691

[22] Filed: Feb. 26, 1997

[30] Foreign Application Priority Data

Oct. 24, 1996 [JP] Japan ..... 8-301178

[51] Int. Cl.[6] ..... G10D 1/08; G10D 3/00

[52] U.S. Cl. ..... 84/267; 84/291; 84/743

[58] Field of Search ..... 84/723–743, 267, 84/291, 292

[56] References Cited

U.S. PATENT DOCUMENTS

| | | | |
|---|---|---|---|
| 2,167,486 | 7/1939 | Moertel | 84/267 |
| 3,722,345 | 3/1973 | Dopera | 84/267 X |
| 4,254,683 | 3/1981 | Nulman | 84/743 X |
| 4,334,452 | 6/1982 | Morrison, III et al. | 84/267 X |
| 5,637,823 | 6/1997 | Dodge | 84/743 |

*Primary Examiner*—Stanley J. Witkowski
*Attorney, Agent, or Firm*—Ostrolenk, Faber, Gerb & Soffen, LLP

[57] ABSTRACT

The body of an electric guitar includes a lower member defining the bottom of the guitar and having a concave on its upper surface for receiving an upper member. The concave is defined by a peripheral edge region of the lower member. The periphery of the upper member meets the inner periphery of the peripheral edge region of the lower member at a peripheral joint line. The height of the upper member where it meets the periphery of the lower member has the same height, forming a smooth joint line on the upper surface of the bottom member and in from the edge region. The materials of the upper and lower members differ from each other and/or their colors are different. The outer periphery of the peripheral edge region is rounded in the thickness dimension.

16 Claims, 3 Drawing Sheets

PLURAL PIECE GUITAR BODY

BACKGROUND OF THE INVENTION

This invention relates to the body of an electric guitar and particularly to such a body assembled from at least two body pieces.

Unlike the body of an acoustic guitar, the body of an electric guitar, does not require a resonance chamber. The body of an electric guitar is, therefore, formed generally flat, almost in a plane. The body is ordinarily made from a single piece and/or a single kind of wood. In addition, the outer periphery, which defines the side of the guitar body, is often formed round in the direction of the thickness as it is the part which often comes into contact with the arms or the body of the performer at the time of the performance.

A high level of design is required for the body of the electric guitar. There are various designs not only for the contours of the outer body shape but also on its surface in many cases. For example, a special pattern or color tone may be pasted to the body surface, e.g. as a pick plate. Recently, moreover, it has been proposed to paste a comparatively thin surface sheet over the entire surface of the body. That sheet carries a design which is different from the reverse side of the sheet, unlike the pick sheet which is only partial.

Where the entire surface of the body has been pasted over with a surface sheet, as shown in the prior art of FIG. 5 hereof, however, a joint 65 between the surface sheet 50 and the main body 60 appears along the peripheral side of the guitar body, not on its top surface. The joint 65 overlaps the contour line of the body, thereby giving the apparent impression that the surface sheet has been pasted, and the whole body lacks an integrated appearance. The side of the body where this joint 65 appears is often formed round in an inclined fashion in the thickness direction as described above. In that case, the cross section of the surface sheet 50 or the cut opening 52 appears like a band of some width particularly at the side of the body.

The cut opening 52 has an outside appearance which is not as beautiful as the surface 51 of the surface sheet 50. In the case where it is painted, too, the cut opening 52 appears different from the painted appearance of the surface 51.

Because it is at the side of the guitar body that can be seen by the performer and which contacts the arms or body of the performer, the joint 65 on the side of the body may give the guitar body an unpleasant feeling to the performer, causing him to feel uneasy as to the firmness of the joint between the top and bottom pieces.

Meanwhile, even though it is said that the plate like body of the electric guitar does not have a resonant function, greater variation can be developed in the generation of sounds when a plurality of materials are employed for the guitar body rather than a single material. If a hard material is combined with a soft material or if a light material is combined with a heavy material, for example, these produce variations in sound generation as compared with guitar bodies using a single material, thereby widening the field of selection in terms of design.

SUMMARY OF THE INVENTION

The invention was proposed in view of the above described circumstances. The object of the invention is to provide a body structure of an electric guitar with a superior outside appearance, which is easily used by the performer, which provides an abundance of sound functions, has a stable quality and is easily prepared.

Broadly, the invention relates to the body structure of an electric guitar. It comprises a first, lower body member. The lower member includes one side that defines the reverse or bottom side of the guitar body. It has an outer periphery generally of the height or thickness of the guitar body. It has a concave formed in the surface of its top side. The concave is surrounded by a peripheral region of a fixed width, which region is provided along and extends slightly inward from the outer periphery of the lower body member.

The body further comprises a second, upper body member, which is comprised of a material that is of a color or a kind different from the first upper member. The thickness or height of the second member is about five millimeters or more. The second member tightly adheres to the inside of the peripheral region of the first member and is fixed integrally with and inside the surface concave so as to be integrated with and also be generally of the height of the upper surface of the peripheral edge region. The width of the peripheral region from the outer periphery to the inner periphery of the concave is in the range between five and ten millimeters. The outer periphery is formed round in the thickness direction.

The materials of the first body member and of the second body member are such that one is of a relatively light and soft material, while the other is of a relatively heavy and hard material. For example, the material of the first member may be selected from mahogany, alder, bass-wood or ash while the material of the second member may be selected from various kinds of maples, or walnut, Hawaiian koa or karin. The whole guitar body is preferably coated with a single paint, which may be transparent to permit viewing the wood beneath the paint.

Other objects and features of the invention are explained with reference to the accompanying drawings.

DESCRIPTION OF THE PREFERRED EMBODIMENT

Figure 1:
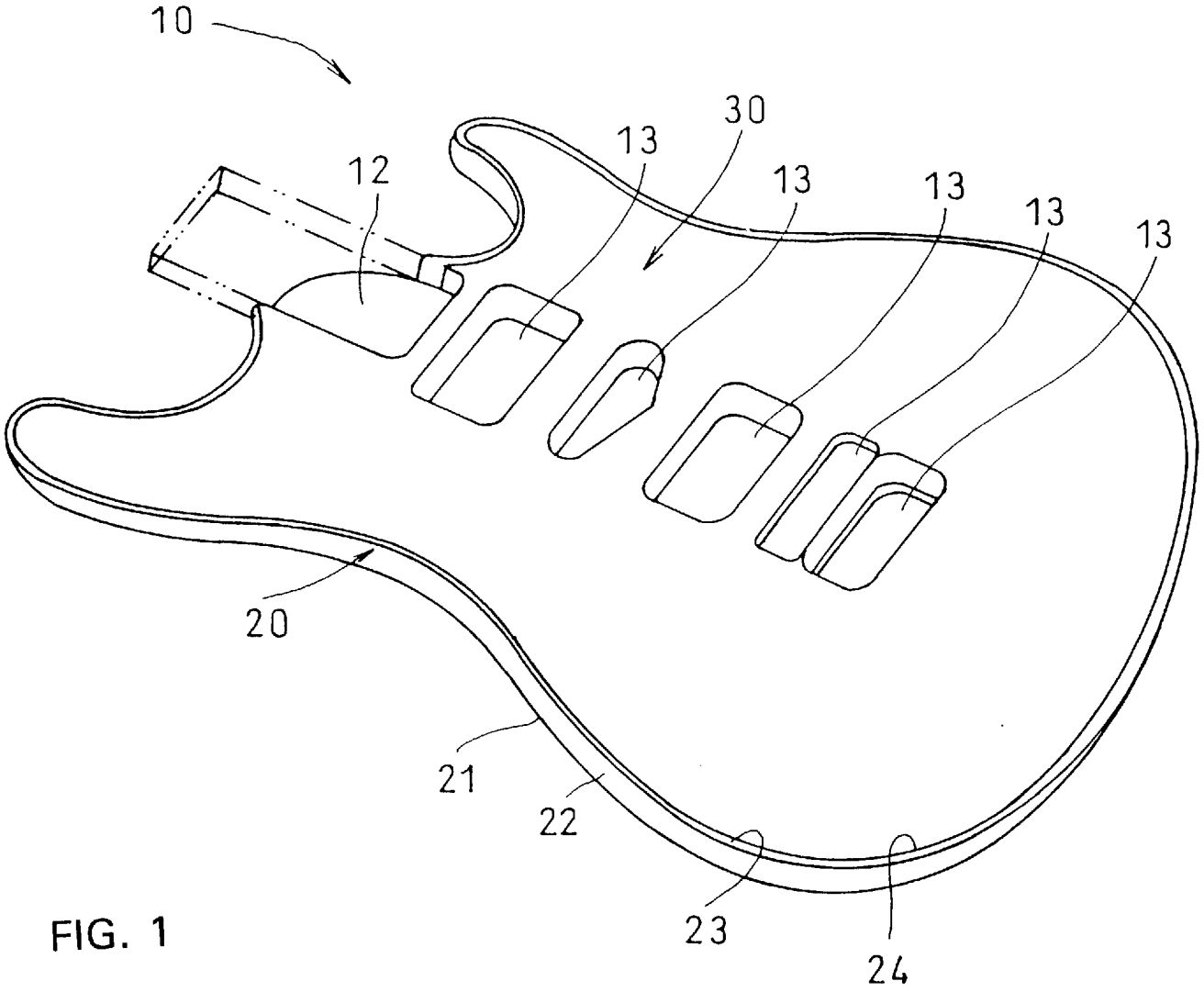
FIG. 1 is an oblique view of an entire body of an electric guitar according to the invention.
Figure 2:
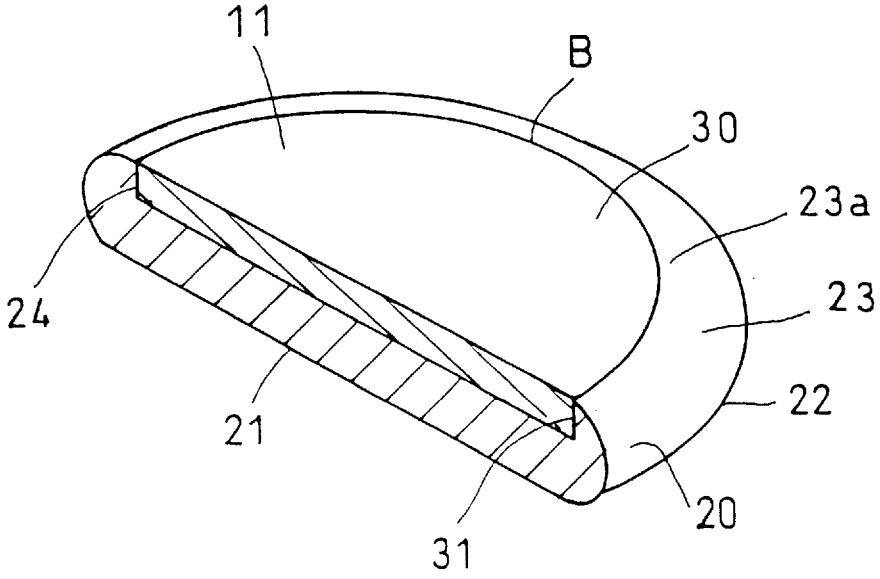
FIG. 2 is a partial, perspective view and cross section of the body.
Figure 3:
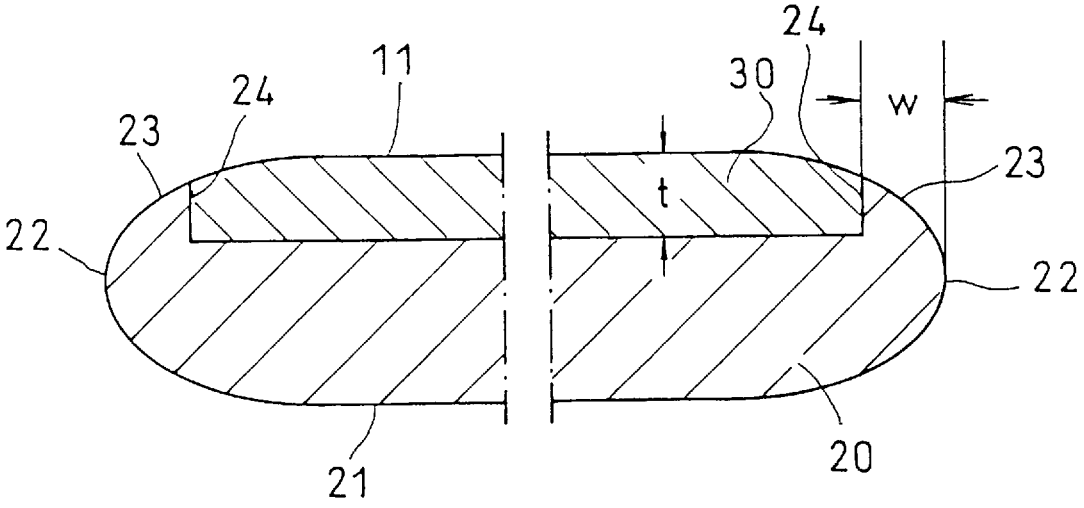
FIG. 3 is an expanded cross section of the body with the intermediate part omitted.

The body 10 of an electric guitar according to the invention comprises a first, lower body member 20 and a second upper body member 30 shown in FIGS. 1 through 3.

The first lower member 20 has an underside, which is the reverse or bottom surface 21 of the guitar body, an outer periphery 22 that defines the exterior of the guitar body and a top side in which a concave recess 24 is formed by the peripheral edge region 23 having a fixed width. The peripheral edge region is provided along the outer edge of the member 20.

Figure 5:
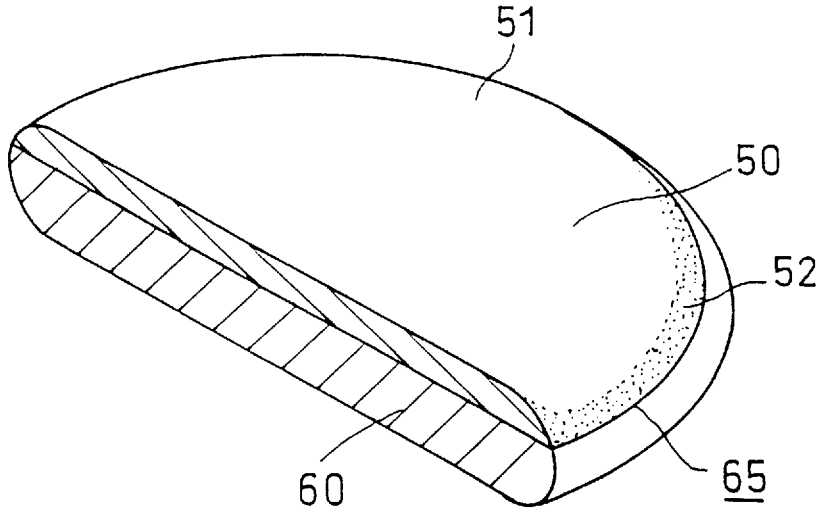
FIG. 5 PRIOR ART
FIG. 5 is a partial perspective view and cross section of the body of a guitar according to the prior art, showing a surface sheet pasted to the top surface of the guitar body.

The second upper member 30 is comprised of a material which is of a color and/or kind different from those of the first member 20. The second member is integrally buried and fixed in the surface concave 24 and is shaped around its periphery so that it tightly adheres to the inside of the peripheral edge region 23 of the first member. The second member is also at the same surface or height as the upper surface 23*a* of the peripheral edge region and does not project above it, as in prior art FIG. 5.

The guitar body has a neck holding part 12 and several openings 13 for the functional parts of the electric guitar, such as an installation concave or opening for the accommodation of the pickup part, the saddle part and the tremolo device, etc.

The first member 20 defines the outer shape of the whole guitar body 10. The second member 30 is buried in and fixed in the surface concave 24 of the first member.

As noted, the surface concave 24 is formed by the peripheral edge region 23 which is of a certain fixed width and is provided along the outer edge of the outer peripheral part 22 of the first member 20, which serves as the outer peripheral part of the guitar body 10. The first member 20 and the second member 30 meet at a linear joint at the boundary line B which appears on the top surface of the guitar body and extends parallel and along the outer edge of the outer peripheral part of the guitar body 10. The boundary line B makes the contour of the plane of the guitar body 10 that has been determined in various designs more apparent.

The boundary line B offers conservative attractiveness when it is within the range of five to ten millimeters from the outer peripheral edge of the guitar body 10. It is preferable that the width w of the peripheral edge region 23 (FIG. 3) be in the range between five and ten millimeters.

In addition, the thickness, i.e., the height, of the second member 30 that is fixed in the surface concave 24 (FIG. 3) should desirably be five millimeters or more in consideration of its effect upon the feeling of the mass of the guitar body and upon the generation of sound. When the thickness of the second member is less than five millimeters, the mass feeling may be undesirable and its effect on the generation of the sound becomes insufficient.

The invention is advantageous when the outer periphery 22 of the guitar body 10 is formed to be round in its thickness direction.

Figure 4:
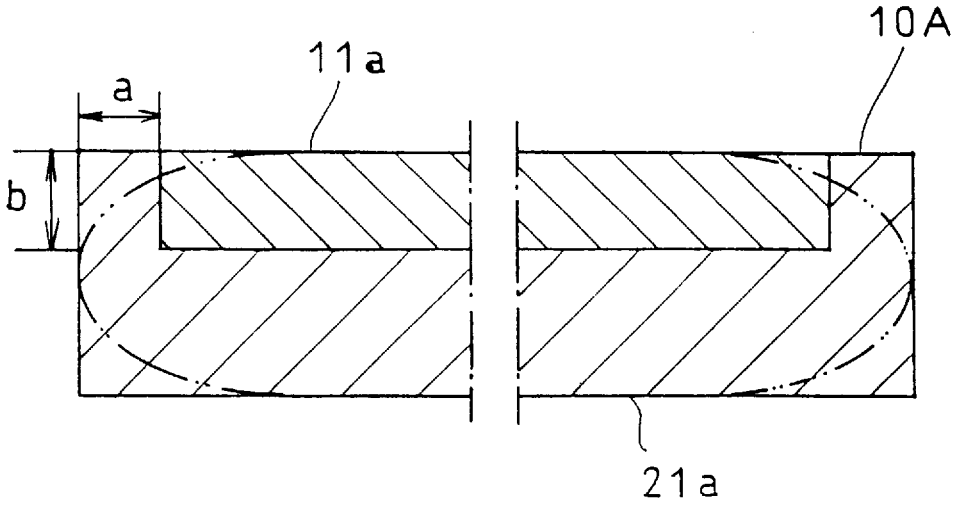
FIG. 4 is a cross section showing the manufacturing process for the body.

For instance, the guitar body shown in FIGS. 1 through 3 is formed by roundly curving the side of the member 10A after the first member 20 and the second member 30 have been joined integrally, as shown in FIG. 4. In the guitar body where the second member 30 is integrally buried and fixed in the surface concave 24 of the first member 20, the joint appears like a line on the top side of the body, offering an attractive finish without the cut opening appearing as described earlier.

Moreover, selecting the materials for the first member 20 and the second member 30 to be as greatly different as possible enables an increase in variations in outside appearance and in sound generation. Either the first member 20 or the second member 30 is light weight and soft, while the other member is relatively heavy weight and hard.

For example, either of the first or the second member 20 or 30 may be made of mahogany, alder, bass-wood or ash, etc., while the other member may be made of various kinds of maples, walnut, Hawaiian koa or karin, etc., which is relatively heavier and harder as compared with the first mentioned member. For example, the first mentioned member may be of the lighter and softer material.

Among these woods, various kinds of maples, etc. have a marble like grain, which is capable of offering a peculiar body surface in terms of outside appearance, with an added variation in terms of sound quality as compared with a body made of a single material.

The guitar body 10 has a final coating. Where the first member and the second member are formed of materials which are of different colors or different kinds, coating both members with the same paint provides different outside appearances because of the different textures or different bases. When the differences in the grains or textures are to be displayed, a single transparent paint may be employed.

According to the guitar body structure of the invention, where the first and second members, which are made of materials of different colors or different kinds, are combined, the outside design can be better and the breadth of the selection of the sound functions can be increased, as compared with use of a single material for the body.

According to the invention, the second member is integrally buried and fixed in the surface concave formed in the first member. The first member includes the reverse side or back side of the guitar body, the outer peripheral part and the surface concave part that is formed by the peripheral edge region of a certain fixed width provided along the outer edge of the outer peripheral part. Therefore, the joint between the two members appears as a boundary line on the top body surface and extending parallel to the outside edge of the outer periphery of the guitar body.

Accordingly, the joint does not appear on the outer periphery of the guitar body. As a result, there is an integral feeling to the body as a whole. Its outside appearance is satisfactory, and it feels good to the user. As a cut opening which is the cross section of the material does not appear, even where the outside peripheral part is made round, in particular, it becomes possible to obtain a good outside appearance. In addition, the joint becomes firmer, and stable guitar bodies without variations in their quality can be easily manufactured.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A body for an electric guitar, comprising a generally flat, said lower member which includes a bottom side of the guitar body and a top side of the lower member, the top side having a concave therein, defining an inner periphery of a peripheral edge region of the lower member around the concave, the peripheral edge region having a predetermined width dimension and having the inner periphery at the concave;

an upper member disposed in the concave in the lower member, being shaped to the profile of the concave and being integrally fixed inside the concave, the upper member defining an upper surface of the guitar body and having an outer periphery at the upper surface;

the lower and upper members meeting at a outer peripheral joint around the periphery of the upper member and the inner periphery of the lower member.

2. The guitar body of claim 1, wherein the outer periphery of the upper member, where it meets the inner periphery of the lower member, is the height of the peripheral edge region of the lower member for defining a smooth joint between the lower member and the upper member.

3. The guitar body of claim 2, wherein the thickness of the upper member in the concave is at least five millimeters.

4. The guitar body of claim 2, wherein the peripheral edge region has an exterior periphery that is formed round in the direction of the thickness of the bottom member.

5. The guitar body of claim 1, wherein the width of the peripheral edge region of the lower member is in the range between five and ten millimeters.

6. The structure of claim 5, wherein the thickness of the upper member in the concave is at least five millimeters.

7. The guitar body of claim 1, wherein the lower member is comprised of a first material and the upper member is comprised of a second material.

8. The guitar body of claim 7, wherein the upper member is of a material different from the lower member.

9. The guitar body of claim 8, wherein the material of the lower member is of a different weight and density than the material of the upper member.

10. The guitar body of claim 8, wherein the material of the lower member is of a different color than the material of the upper member.

11. The guitar body of claim 8, wherein the material of one of the lower and upper members is lighter and softer, and the material of the other of the lower and upper members is relatively heavier and harder.

12. The guitar body of claim 11, wherein the material of one of the lower and upper members is selected from the group consisting of mahogany, alder, bass-wood and ash, and the material of the other of the lower and upper members is selected from the group consisting of various kinds of maple, walnut, Hawaiian koa and karin.

13. The guitar body of claim 8, wherein the entire guitar body is coated with a single covering of paint.

14. The guitar body of claim 13, wherein the paint coating the guitar body is a transparent paint.

15. The guitar body of claim 8, wherein the materials of the lower and the upper members are respectively different materials having different appearances.

16. The guitar body of claim 15, wherein the materials of the lower and upper members are of different colors.

* * * * *